US009163418B2

(12) United States Patent
Ditta et al.

(10) Patent No.: US 9,163,418 B2
(45) Date of Patent: Oct. 20, 2015

(54) REMOVABLE AND RE-USEABLE CONSTRUCTION SAFETY BARRIER

(71) Applicants: Paul Luke Ditta, Stouffville (CA); Vito Ditta, Queensville (CA); Joseph Ditta, Kleinburg (CA)

(72) Inventors: Paul Luke Ditta, Stouffville (CA); Vito Ditta, Queensville (CA); Joseph Ditta, Kleinburg (CA)

( * ) Notice: Subject to any disclaimer, the term of this patent is extended or adjusted under 35 U.S.C. 154(b) by 238 days.

(21) Appl. No.: 13/694,839

(22) Filed: Jan. 10, 2013

(65) Prior Publication Data

US 2014/0191174 A1 Jul. 10, 2014

(51) Int. Cl.
*E04H 17/16* (2006.01)
*E04G 21/32* (2006.01)

(52) U.S. Cl.
CPC ..... *E04G 21/3204* (2013.01)

(58) Field of Classification Search
CPC ..... E04H 17/16; E04F 11/1812
USPC ..... 256/13.1, 24, 25, 31, 65.01, 65.02, 256/65.03, 65.06, 65.14, 73; 52/169.7, 52/DIG. 12; 182/113; 404/6, 9
See application file for complete search history.

(56) References Cited

U.S. PATENT DOCUMENTS 1,211,059 A * 1/1917 Blank ..... 256/1
1,984,452 A * 12/1934 Ballew ..... 472/87
3,385,567 A * 5/1968 Case et al. ..... 256/24
3,388,892 A * 6/1968 Case ..... 256/13.1
3,406,946 A * 10/1968 Saultz ..... 256/19
3,728,862 A * 4/1973 Meredith ..... 405/285
3,980,278 A * 9/1976 Elias ..... 256/59
4,137,576 A * 2/1979 Greene ..... 52/73
5,108,224 A * 4/1992 Cabaniss et al. ..... 256/12.5
5,152,507 A * 10/1992 Lee ..... 256/13.1
5,586,423 A * 12/1996 Mullen ..... 52/653.2
5,671,584 A * 9/1997 Mueller ..... 52/780
7,255,312 B2 * 8/2007 Melic ..... 248/200.1
7,530,551 B2 * 5/2009 Kuenzel ..... 256/65.14
7,726,635 B2 * 6/2010 Heard ..... 256/48
7,740,233 B1 * 6/2010 Larsen ..... 256/47
8,702,068 B2 * 4/2014 Mellins et al. ..... 256/25
2012/0049142 A1 * 3/2012 Lill ..... 256/13.1

* cited by examiner

*Primary Examiner* — Michael P Ferguson
*Assistant Examiner* — Nahid Amiri

(57) ABSTRACT

A removable safety barrier for a construction site pit, in which piles support the sides of the pit, and having a plurality of upright barrier posts at spaced intervals, supported on the piles, the barrier posts extending below grade level around the edge of the construction pit and also above grade level; a plurality of retention panels, shaped to fit between adjacent posts; personal barrier supports secured to the barrier posts above grade level; and personal barrier members supported in the supports, extending substantially transversely between the upright barrier posts, and the retention panels being located below grade level extending between the barrier posts.

9 Claims, 7 Drawing Sheets

5

7

REMOVABLE AND RE-USEABLE CONSTRUCTION SAFETY BARRIER

FIELD OF THE INVENTION

The invention relates to a safety barrier used on a construction site, and in particular to a safety barrier which is erected around an open pit excavation to prevent debris from the upper edge of the pit, from falling into the pit, and is removable for re-use elsewhere.

BACKGROUND OF THE INVENTION

In the construction of buildings, a pit is usually excavated into which the footings and underground portions of the building will be erected. It is common for excavations to go down three or four floors at least. The sides of the pit are usually substantially vertical, and in order to support the earth around the pit, I-beams or piles, are installed at intervals. These beams or piles are driven in by pile drivers, down into the earth prior to or during excavation, as well known in construction practice. Side Wall panels, such as concrete or the like, are then formed or placed between the vertical I-Beams as excavation continues downwardly. In this way the sides of the pit are maintained and supported, without collapsing into the pit. It is however, not an unusual experience for the concrete or side wall panel material or earth around the upper edge of the pit at or close to ground level, will start to deteriorate and portions of debris may fall down into the pit. This is both hazardous, and also constitutes material which must eventually be removed for the construction of the underground portion of the building to proceed uninterrupted.

In addition to this, while the pit is being excavated, and even after the underground portion of the building has been erected, the edge of the pit remains a hazard to workers and pedestrians alike. It has been the practice for years to install safety barriers around the grade level edge of such a pit, in order to prevent any accidents occurring to workers and pedestrians around the edge of the pit.

In addition to this, it is now becoming desirable to install some protective barrier extending from the grade level edge of the pit downwardly, so as to then prevent debris falling from the upper portions of the wall panel materials holding the earth in place.

The erection of such barriers, both below grade level and above grade level is becoming an essential feature of modern day construction. Numerous forms of safety barriers have been proposed in the past, which can be erected around an open pit at grade level. However, these prior proposals are not generally suitable for erection around major excavations such are the practice in the erection of high rise buildings. In these cases, excavation will start and the piles will be driven into the earth around the perimeter of the excavation. Once excavation has removed more than a small portion of the earth, it becomes difficult to erect a safety barrier around the perimeter. The safety barrier should be securely erected so as to retain the earth and wall panels around the upper edge of the pit or excavation. In addition, the safety barrier preferably will extend above the perimeter of the pit, ie. above grade level, for personal safety. Securing such a safety barrier in position around a large excavation is a difficult and challenging problem. In addition, since the construction of the barrier will involve a substantial cost and material resources, it is desirable, as far as possible, that it is capable of being removed when the building is completed, or at a stage where the site is no longer hazardous, and the barrier can then be reinstalled around a new building site.

BRIEF SUMMARY OF THE INVENTION

With a view to providing a removable safety barrier for a construction site pit, the invention provides a plurality of upright barrier posts, a plurality of retention panels shaped to fit between said posts, personal barrier supports secured to said upright posts above grade level and personal barrier members supported in said supports, extending substantially transversely between said upright barrier posts, said barrier posts extending below grade level around the edge of a construction pit, and also above grade level, and said retention panels being located below grade level extending between said barrier posts.

Preferably there will be a transverse grade level metal beam, extending transversely between adjacent piles at grade level, and a below grade beam extending between said piles below grade level.

Preferably such transverse grade level beam provides support around said construction pit, at grade level for the barrier posts, and the below grade beam supports the lower ends of the posts.

Preferably the barrier posts will be provided with a fastening clip system, and the clips will be attachable to the transverse grade level beam, so as to secure the barrier posts to the transverse beam, and hold the entire barrier in position.

Preferably the barrier posts will be dimensioned so as to fit in the below grade channel.

Preferably the retention panels will be supported in rectangular panel frames, and the panel frames will be shaped to inter-fit with the below grade beam.

Preferably the barrier posts will be formed of hollow rectangular tubular members, and support brackets will be provided on such posts, to support the panel frames.

Preferably, the barrier frames, and panels, extend partially upwardly above grade level, in the preferred case, for additional security.

Preferably the below grade beam is a channel with its open side facing upwardly to receive the lower ends of the posts.

The invention further provides a method of erecting a removable safety barrier around a construction site excavation, in which a transverse grade level beam and a below grade beam are secured to the upright piles around the excavation, barrier posts are then attached to the grade level beam and the channel at intervals, retention panels are then installed between the barrier posts, and personal barrier rails are then secured to portions of the barrier posts extending above grade level.

Preferably, the barrier posts will be attached to the transverse grade level beam by a series of clips which will be dis-engagable, when the safety barrier is no longer required.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

As already explained above, the invention provides a safety barrier which provides two separate safety functions.

In the first place a lower portion of the barrier extends from grade level down a certain distance. The purpose is to retain any loose debris, rubble or the like, which may develop around the edge of the construction pit.

The second function is to provide a personal safety barrier extending above grade level around the same construction pit.

By providing a safety barrier which combines both features, it is possible to provide a greater degree of safety for construction workers on site, both when working below grade and when working around the edge of the pit above grade.

Such a safety barrier can be made to very high standards and will be essentially modular, and can be installed at a construction site when required, and can then be removed when it is no longer required and taken to another site.

As explained above, it is a particular feature of the invention that the barrier can be installed around a construction site where major excavation is taking place, with the barrier being installed after at least some excavation has started, by attaching the barrier directly to the upright piles surrounding the perimeter of the site.

Figure 1:
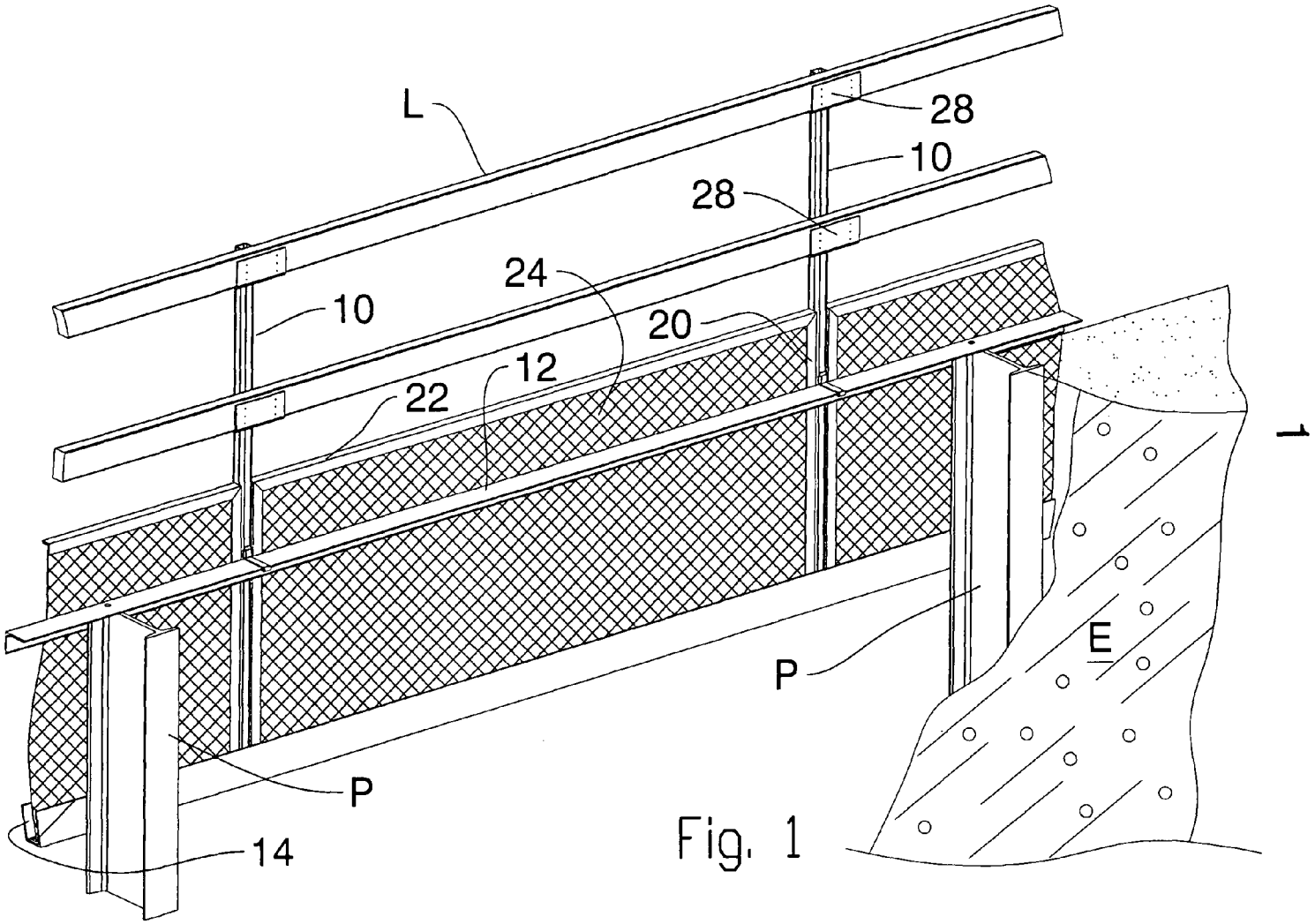
FIG. 1 is a general perspective of a single wall of a typical construction site pit, showing the safety barrier attached in position.

Referring now to FIG. 1, it will be seen that this is a general illustration in which the grade level edge (G) of the earth (E) surrounding a particular construction site pit is shown. As is well known, the sides of such a construction pit are supported by embedding generally vertical steel piles (P) at intervals around the site. Retention members (not shown) are erected between the piles.

The piles are usually held in place by various steel cable systems (not shown) which extend back into the terrain around the site, and which are connected to the piles at various levels. The erection of such piles and cables around the edges of the construction site are well known and require no further description.

The safety barrier itself will be seen to comprise a plurality of upright barrier posts (10), which are of generally tubular rectangular steel.

The posts (10) are secured to transverse steel members, comprising a grade level beam (12) and a below grade level beam (14) spaced downwardly from the beam (12) and which extend transversely at right angles to the upright posts (10).

The grade level beam (12) in this embodiment, is an L-shape in section, defining a horizontal arm (16) and a vertical arm (18) meeting at right angles. The horizontal arm (16) extends outwardly from the post (10) at right angles and is welded to the tops of piles (P).

The below grade beam (14) in this embodiment are channels of generally U-shape in section, and are welded to piles (P). The below grade beams (14) are open upwardly and receive the lower ends of posts (10), and support them. The barrier is thus secured in position around the grade level of the open pit, to the piles (P) which support the sides of the pit.

This form of attachment provides a secure mounting for the barrier in an efficient manner, and at the same time permits ease of installation and of removal when the barrier is no longer required so that it may be taken to another location and reused.

Normally the channel and grade level beam will be left in position.

In order to retain debris and loose earth, concrete and the like, around the top edge of the construction pit, and below grade level, rectangular frames are provided comprising vertical side members (20) and transverse cross members (22). Within the frames, any suitable form of retention panel is provided. In this case the retention panel comprises steel mesh material (24). The dimensions of the frame members are designed to fit between the posts (10) within the below grade beam or channel (14).

In order to provide support for the upper regions of the rectangular frames, transverse holding brackets (26) are secured to the posts. These holding brackets engage the frames as shown (FIG. 14) on the excavation side of the frames and prevent them from falling into the construction site.

In order to provide for the second function of the barrier, namely providing a personal safety barrier extending above grade level, to protect workmen and pedestrians around the edge of the construction pit, there are provided on each post (10), at least two spaced apart U-shaped channel brackets (28). The U-shaped channel brackets (28) are welded to the inward (ie. Grade side) facing walls of the posts (10). Suitable barrier rail members such as lumber (L) can be placed in the upper and lower U-shaped channels, to complete the safety barrier. Obviously if it is desired, other forms of barrier material may be provided in place of the lumber (L).

In this way, the safety barrier provides protection around the edge of a construction pit, extending below the upper edge of the construction pit and extending above grade level, and providing secure retention of below grade level material, and providing personal safety above grade level. The entire barrier system can be installed by workmen as the excavation of the construction pit is continuing and can be removed and taken to another location when it is no longer required.

Figure 2:
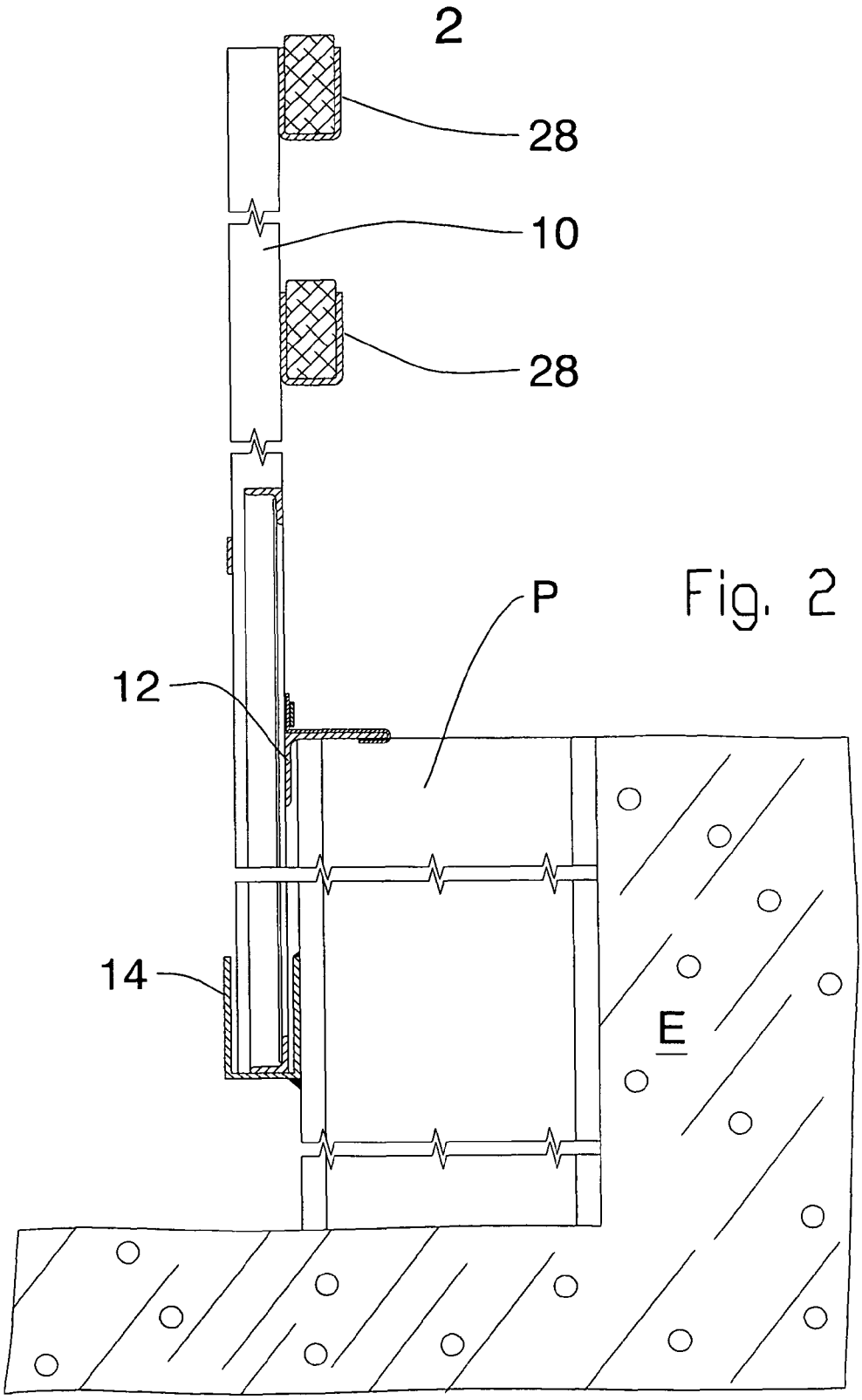
FIG. 2 is a section along line 2-2 of FIG. 1.

It will be appreciated that the foregoing description is of a general nature, particularly with reference to FIGS. 1 and 2.

The various components of the fence and the way in which they are erected, are now describe with reference of FIGS. 3 to 14.

Figures 3, 4, 5:
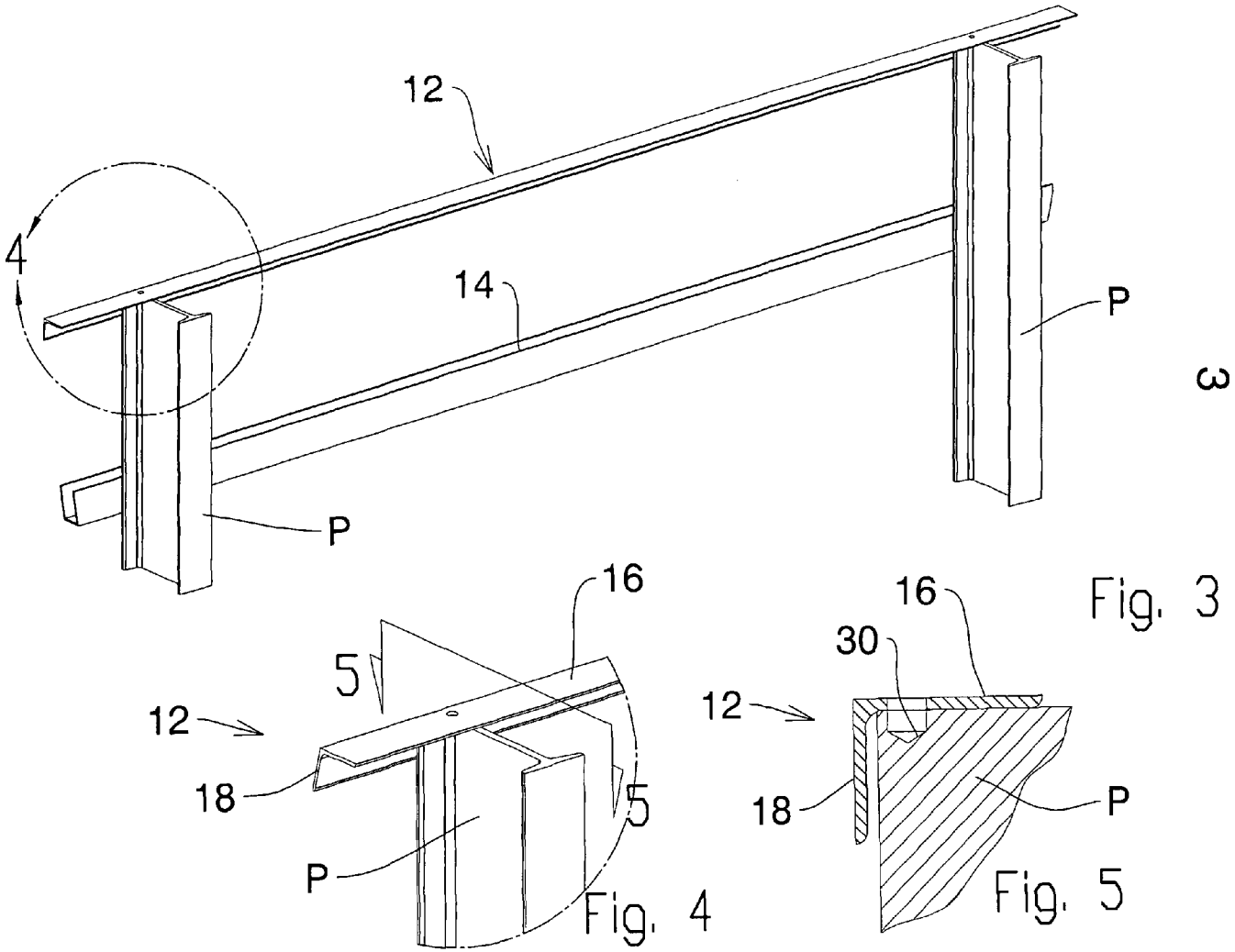
FIG. 3 is a perspective illustration of a first step in the assembly of the safety barrier.
FIG. 4 is an enlarged detail of FIG. 3 within the circle 4.
FIG. 5 is a section along the line 5-5 of FIG. 4 showing the welding of the transverse grade level beam to the piles.

In FIG. 3, the piles (P) are shown along one edge of a construction site, supporting and holding back the earth (E). The transverse grade level beam (12) is shown, having a L-shaped configuration. The horizontal portions of the L-shape are shown plug welded to the tops of the piles (P). For this purpose suitable weld receiving holes (30) (FIG. 5) are drilled in the top of the piles (P) and corresponding holes are drilled through the horizontal portions of the transverse grade level beams (12).

The below grade beams or channels (14) are then welded to the piles at a suitable distance below grade, with their U-shapes facing upwardly, to receive the lower ends of the vertical posts (10) and the retention panels as described below.

The attachment and the welding of grade level beams and below grade channels is a first step in the erection of the safety barrier system and can easily be accomplished by workmen working on the partly excavated pit around the construction site.

This can be done at an early stage in excavation as soon as sufficient earth has been removed to expose the upper few feet of the piles. Welders can simply walk on the surface of the excavated terrain, and weld the beams (12 and 14) directly to the piles (P).

Figure 6:
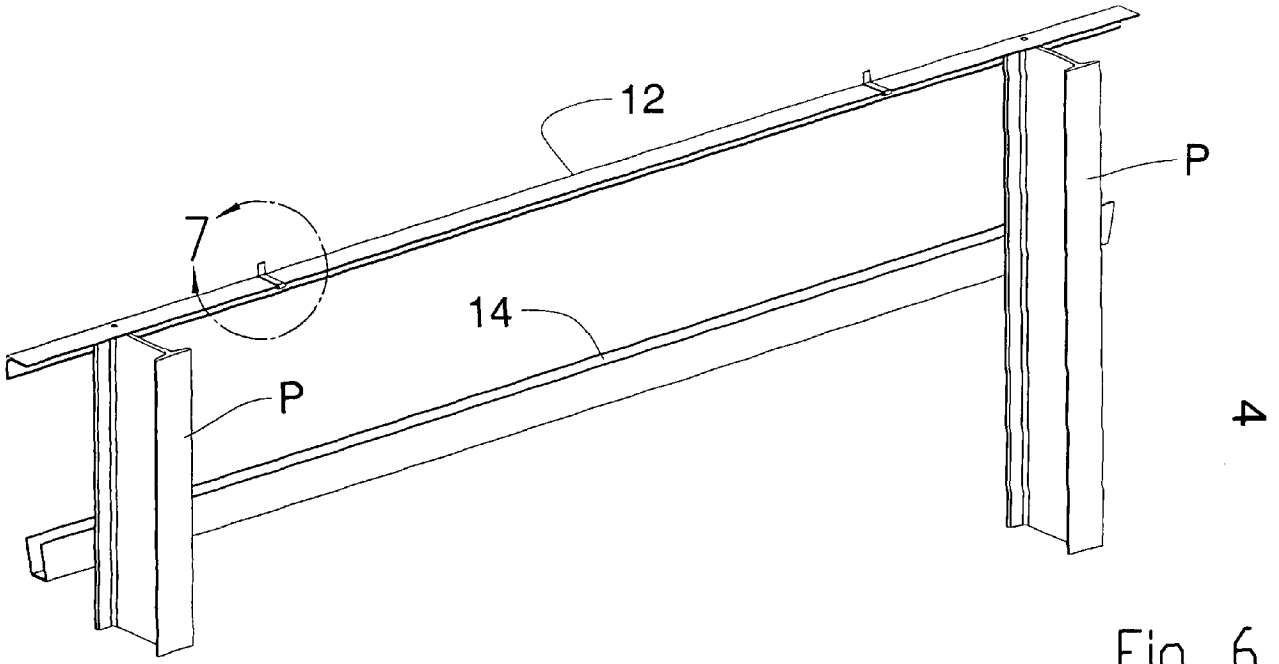
FIG. 6 is a schematic perspective illustration showing a second step in the erection of the safety barrier.
Figure 8:
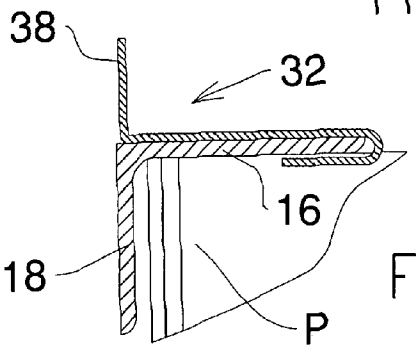
FIG. 8 is a section along the line 8-8 of FIG. 7.
Figure 7:
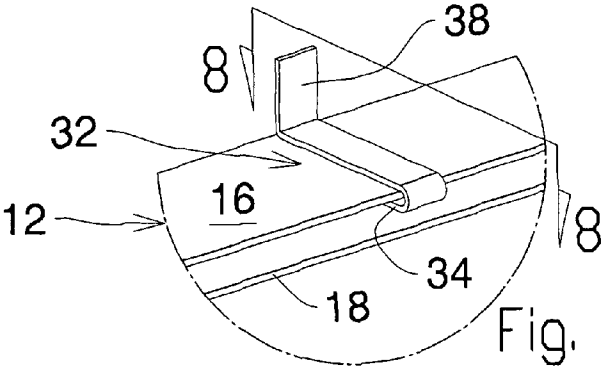
FIG. 7 is an enlarged detail of FIG. 6 within the circle 7.
Figure 9:
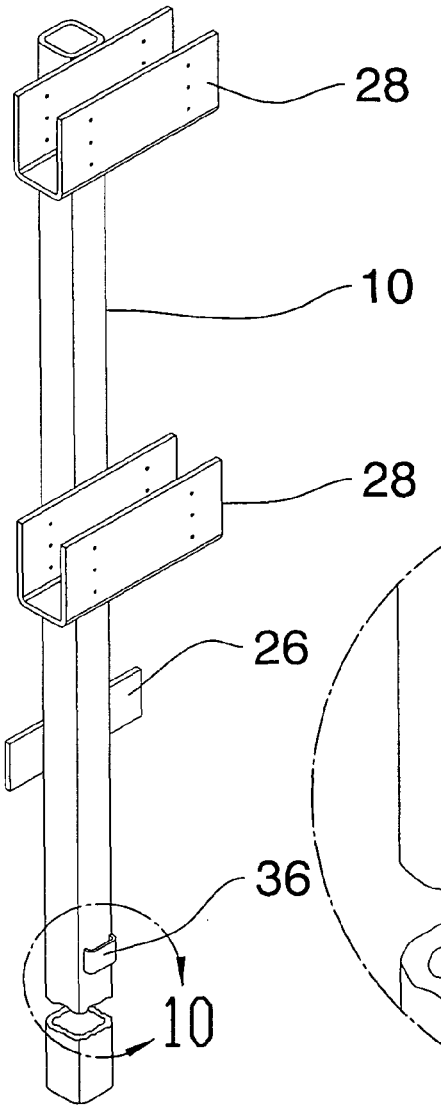
FIG. 9 is a schematic illustration in perspective, showing the vertical barrier posts.
Figure 10:
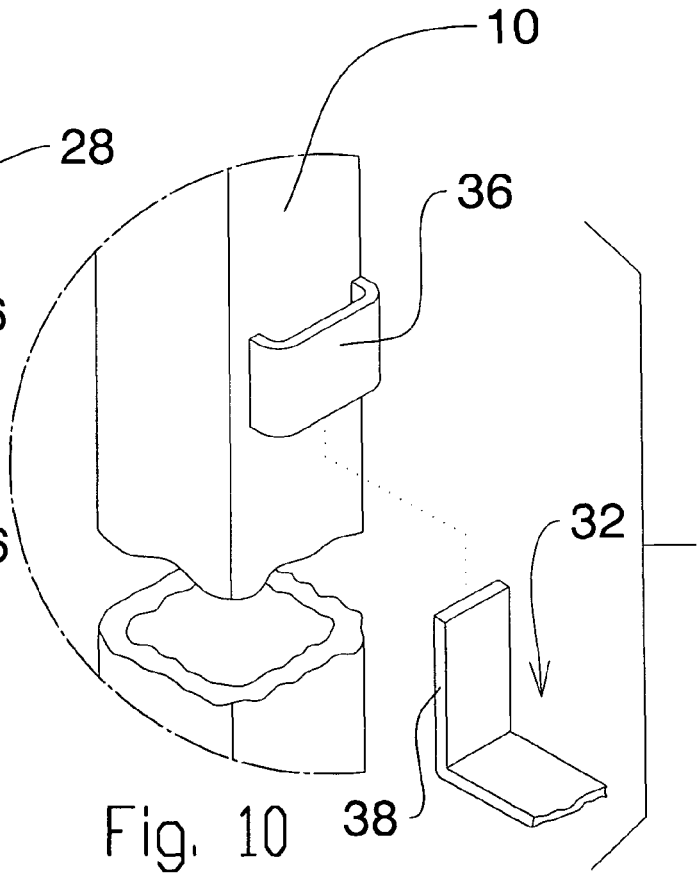
FIG. 10 is detail of circle 10 of FIG. 9.
Figure 11:
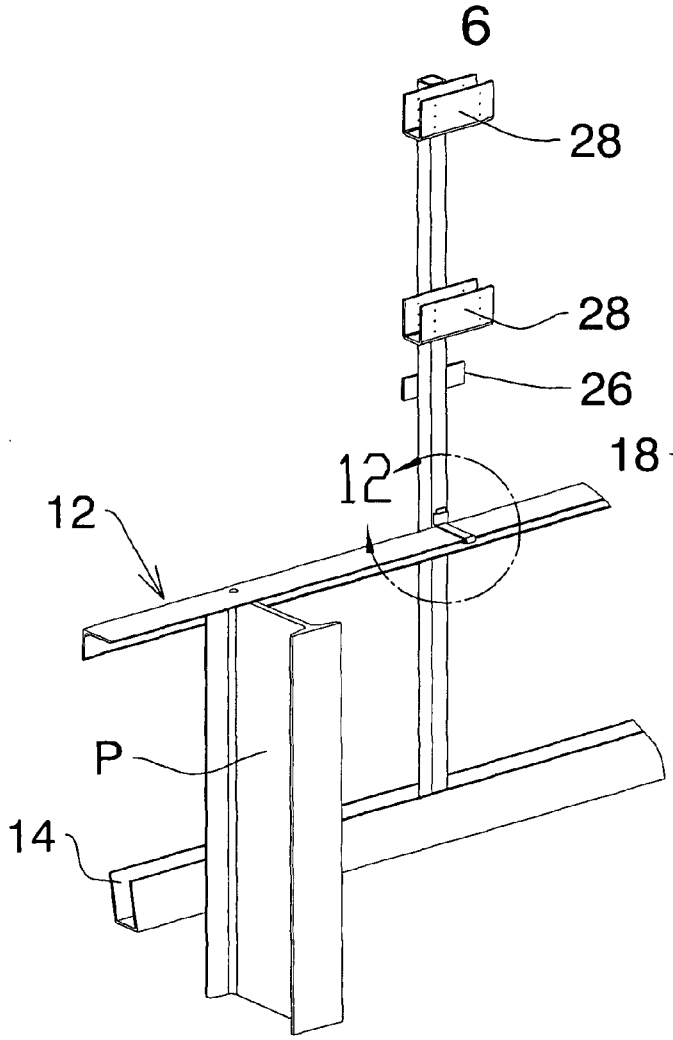
FIG. 11 is a perspective of the post and beam connection.
Figure 13:
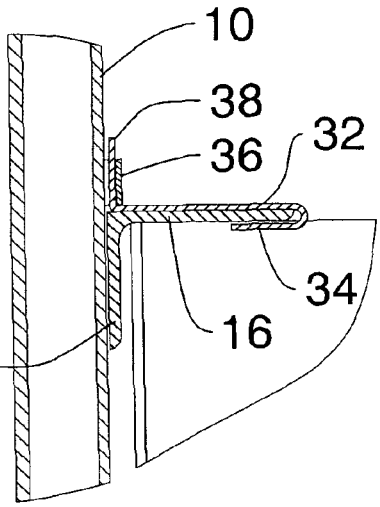
FIG. 13 is a section along the line of 13-13 of FIG. 12.
Figure 12:
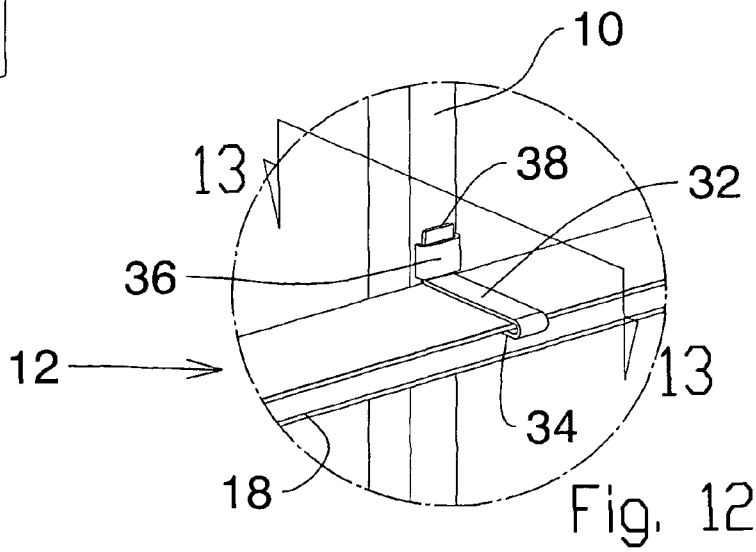
FIG. 12 is a detail of circle 12 of FIG. 11.

The next steps are shown in FIGS. 6, 7 and 8.

Clips (32) of L-shape are provided, having lips (34). Lips (34) are slid onto the grade level beam (12) at intervals.

Individual upright barrier posts (10) are placed with their lower ends received in the below grade channels, and the upright barrier posts (10) are attached to the grade level transverse beam (12). The posts (10) are attached by means of metal sleeves (36), secured to each post. The sleeves slip onto the flanges (38) of clips (32).

Figure 14:
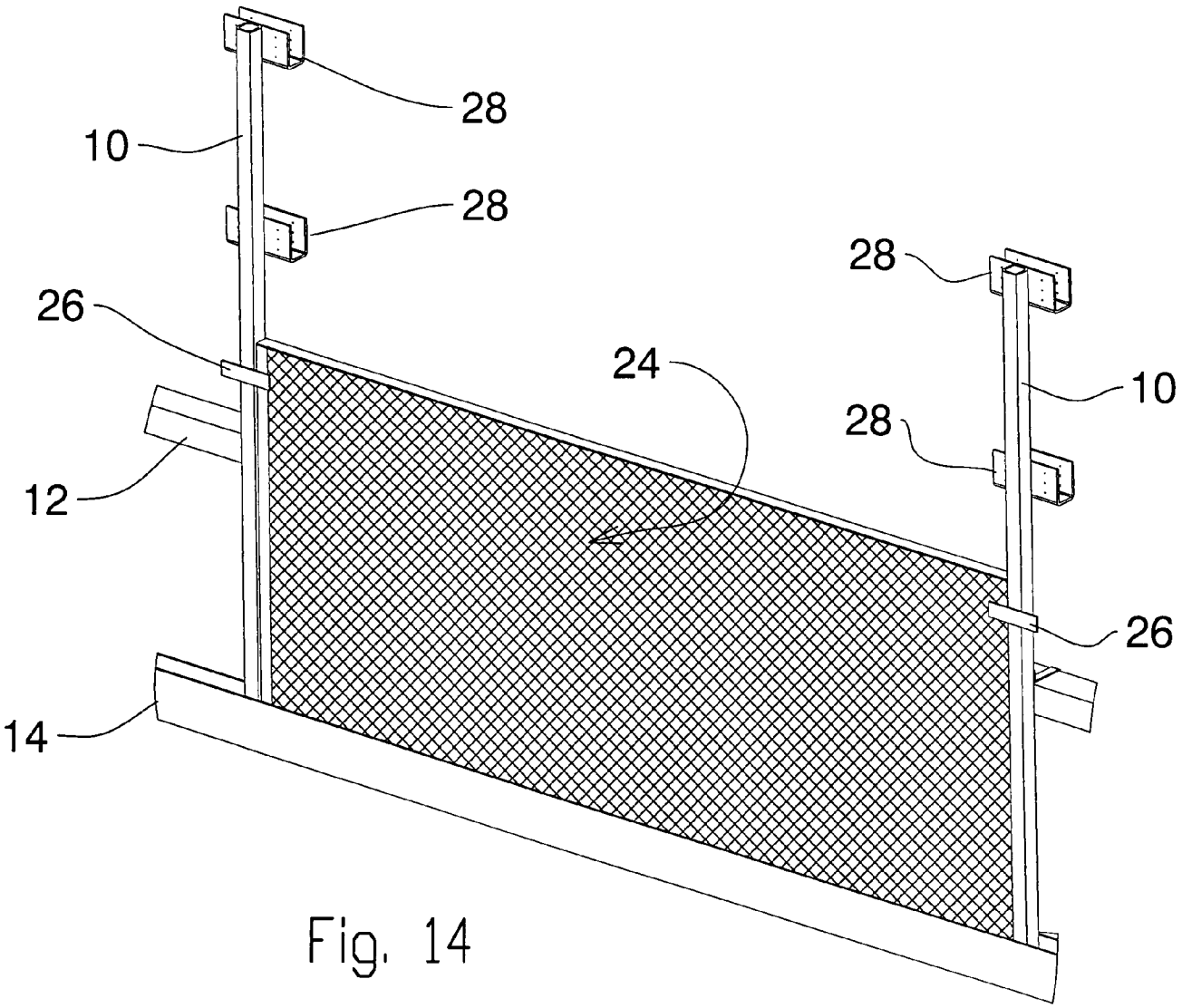
FIG. 14 is a perspective illustration, showing the inter connection between the retention panels and the vertical barrier posts and the horizontal grade level and below grade beams.

The final step is illustrated in FIG. 14, consisting of inserting retention panels (24) between the vertical posts (10), and sliding them down until they rest in the below grade channel (14). The brackets (26) prevent the panels from falling into the pit. Any suitable pedestrian barriers such as lumber (L) can then be placed in the U-shaped channels on the portions of the vertical posts (10) extending above the grade.

Removal of the safety barrier system will consist of removing the lumber, removing the retention panels and releasing the vertical posts from clips (32) simply raising the posts (10) until the sleeves (36) are clear of flanges (38), and their lower ends are clear of the below grade channel (14).

In most cases, the below grade channel and the grade level beam will be sacrificed and will be left in position. It would of course be possible to remove them but this would be a relatively lengthy job and the saving in costs would be outweighed by the expense of removing those pieces.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A removable safety barrier for a construction site pit, the pit having sides below grade level and an upper edge at grade level and in which piles support the sides of the pit, the safety barrier being removably attachable to the piles, and being removable for re-use as required, and comprising:

a transverse grade level metal beam extending transversely between adjacent piles at said grade level and configured to be permanently secured to said piles;

a below grade metal beam extending between said piles below grade level, below said transverse grade metal beam, said below grade beam defining an upwardly open channel for reception of portions of upright barrier posts therein at spaced intervals, and configured to be permanently secured to said piles;

a plurality of upright barrier posts received within said upwardly open channel at spaced intervals and resting releasably on said below grade beam and extending below grade level around the edge of said pit and being releasably attached to said grave level metal beam;

plurality of debris retention panels shaped to fit between adjacent said posts and means on said posts for supporting said retention panels;

personal barrier supports transversely secured to said barrier posts above said grade level, and having personal barrier members supported in said supports and extending substantially transversely between said upright barrier posts above said grade level and in which the retention panels extend below said grade level within said pit for retaining debris from the sides of said pit from falling into said pit, and said retention panels extending partially upwardly above said grade level.

2. The removable safety barrier as claimed in claim 1 including fastening clips attachable to the transverse grade level beam, so as to releasably secure the barrier posts to the transverse grade level beam, and hold the entire barrier in position.

3. The removable safety barrier as claimed in Claim 2 wherein the barrier posts are dimensioned to inter-fit in said upwardly open channel of said below grade beam.

4. The removable safety barrier as claimed in claim 3 wherein the retention panels are supported in rectangular panel frames shaped to inter-fit in said upwardly open channel of said below grade beam.

5. The removable safety barrier as claimed in claim 4 wherein the barrier posts are formed of hollow rectangular tubular members, and including panel support brackets provided on such posts, to support the retention panels.

6. The removable safety barrier as claimed in claim 5 wherein the retention panels extend partially upwardly above grade level, for additional security.

7. The removable safety barrier as claimed in claim 6 wherein the transverse grade level beam is L-shaped defining a horizontal portion for welding to each pile and an upright portion.

8. The removable safety barrier as claimed in claim 2 including flanges on the clips and sleeves on the posts receiving the flanges.

9. The removable safety barrier as claimed in claim 8 including lips on the clips shaped to inter-fit with the transverse grade level beams.

* * * * *